US007713104B2

(12) United States Patent
Saint-Marcoux

(10) Patent No.: US 7,713,104 B2
(45) Date of Patent: May 11, 2010

(54) APPARATUS AND METHOD FOR CONNECTION AND DISCONNECTION OF A MARINE RISER

(75) Inventor: Jean-Francois Saint-Marcoux, Houston, TX (US)

(73) Assignee: Acergy France, S.A., Suresnes (FR)

( * ) Notice: Subject to any disclaimer, the term of this patent is extended or adjusted under 35 U.S.C. 154(b) by 246 days.

(21) Appl. No.: 11/664,408

(22) PCT Filed: Oct. 10, 2005

(86) PCT No.: PCT/EP2005/012030

§ 371 (c)(1),
(2), (4) Date: Nov. 14, 2007

(87) PCT Pub. No.: WO2006/040197

PCT Pub. Date: Apr. 20, 2006

(65) Prior Publication Data

US 2008/0214072 A1 Sep. 4, 2008

Related U.S. Application Data

(60) Provisional application No. 60/617,984, filed on Oct. 11, 2004.

(30) Foreign Application Priority Data

Dec. 21, 2004 (GB) ..... 0427920.4

(51) Int. Cl.
*B63B 22/02* (2006.01)

(52) U.S. Cl. ..... 441/3

(58) Field of Classification Search ..... 441/3
See application file for complete search history.

(56) References Cited

U.S. PATENT DOCUMENTS

| | | | | |
|---|---|---|---|---|
| 3,597,779 | A * | 8/1971 | Morgan | 441/133 |
| 3,913,668 | A * | 10/1975 | Todd et al. | 166/359 |
| 5,553,976 | A * | 9/1996 | Korsgaard | 405/195.1 |

FOREIGN PATENT DOCUMENTS

| | | |
|---|---|---|
| GB | 1573131 | 8/1980 |
| GB | 2320268 | 6/1998 |
| GB | 2344841 | 6/2000 |
| WO | WO 96/36528 | * 11/1996 |
| WO | WO 03/031765 A1 | 4/2003 |

OTHER PUBLICATIONS

Acergy, Hybrid Riser Tower: from Functional Specification to Cost per Unit Length Offshore Engineer, Floating Production, Renewed riser at heart of GB 388, Aug. 1994, p. 33-38.

(Continued)

*Primary Examiner*—Stephen Avila

(57) ABSTRACT

Apparatus for the connection and/or disconnection of a marine riser to a floating vessel comprising, in a main embodiment, a plurality of connecting lines. The, lower ends of these connecting lines are attached to the riser and are arranged to be moveable between a first helical configuration which allows connection, via a turret, between the riser and the floating vessel and a second helical configuration wherein said connecting line is disconnected and. retracted from said floating vessel. A method of installing said connecting lines is also disclosed.

35 Claims, 6 Drawing Sheets

OTHER PUBLICATIONS

The Website for the Offshore Oil & Gas Industry: www.offshore-technology.com/projects/girassol p. 1-4 The Website for the Offshore Oil & Gas Industry: www.offshore-technology.com/contractors/floating_production/apl/press3.html p. 1.
The Website for the Offshore Oil & Gas Industry: www.offshore-technology.com/contractor_images/apl1.jpg p. 1.
Bouy turret loading: www.apl.no/products/prod_btl.asp p. 1-3.
Ocean Resources Online: www.ocean-resources.com/issues/article.asp?ID=416&MagID=19 p. 1-3.
The Website for the Offshore Oil & Gas Industry: www.offshore-technology.com/contractors/floating_procution/sofec/index.html p. 1-3.

* cited by examiner

APPARATUS AND METHOD FOR CONNECTION AND DISCONNECTION OF A MARINE RISER

CROSS REFERENCE TO RELATED APPLICATIONS

This application claims priority from U.S. Provisional Application No. 60/617,984 dated 11 Oct. 2004 and GB 0427920.4 dated 21 Dec. 2004, incorporated herein by reference.

BACKGROUND OF THE INVENTION

1. Field of the Invention

The present invention relates to a marine riser, of the type used in the transport of hydrocarbon fluids (gas, and/or oil, and/or water) from offshore wells.

2. Description of Prior Art

The marine riser typically includes a number of conduits for the transport of fluids and different conduits within the riser tower are used to carry the hot production fluids and the injection fluids which are usually colder. The Marine riser may form part of a so-called hybrid riser, having an upper portion ("jumpers") made of flexible conduit and a lower portion made of rigid spools. U.S. Pat. No. 6,082,391 proposes a particular Hybrid Riser Tower (HRT™) consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background is to be published in a paper Hybrid Riser Tower: from Functional Specification to Cost per Unit Length by J-F Saint-Marcoux and M Rochereau, DOT XIII Rio de Janeiro, 18 Oct. 2001. Other forms of riser tower are described in applications WO 04/051051 and WO 04/051052.

It has been current practice to connect Riser Towers to a FSPO using flexibles in a catenary configuration. Alternatively an earlier version of the Hybrid Riser Tower was connected to a semi-submersible with flexibles in a catenary position (see Garden Banks 388, Offshore Engineer August 1994).

It is also known to attach a riser (in a "lazy wave" or "lazy s" configuration) to a vessel such as a Floating, Production Storage and Offloading vessel (FPSO) via a turret type connector attached to the top of the riser and which mates with a recess usually in the vessel's hull. The turret usually comprises a rotating table and a set of swivels. In a disconnectable turret the rotating table is released and the swivels remain on board. This then retains the vessel at a fixed place but allows it to rotate with the rotating table according to sea and weather conditions, while also allowing the fluid to pass through this connection into the vessel.

In difficult meteorological and sea conditions, particularly when in deepwater and ultradeep water in areas where typhoon or hurricanes can strike, it may be required to disconnect the floating production facilities. It is important that the load imposed on the turret when it is disconnected remains minimal. A substantially rigid riser tower such as a HRT is a suitable means of having a very small load and carrying a number of connections (lines and umbilicals) to the turret.

However, little work has been performed to attach a riser tower or HRT arrangement to a disconnectable turret or loading buoy.

SUMMARY OF THE INVENTION

In a first aspect of the invention there is provided an apparatus for the connection/disconnection of a marine riser to a floating vessel comprising at least one connecting line, attachable to said riser at its lower end and arranged to be moveable between a first helical configuration which allows connection between the riser and the floating vessel and a second helical configuration wherein said connecting line is disconnected and retracted from said floating vessel.

An advantage of the helical path is to maintain a nearly constant curvature consistent with the bending radius of the connecting line (such as a flexible or umbilical), and also to require only a short length of connecting line which is beneficial for vertical loads, and head loss.

Said connection may be via a turret attached to said connecting line, said turret being engagable with said vessel. Alternatively said connection may be via a loading buoy, remote to said vessel, said loading buoy being attached directly to the connecting line or via a turret attached to the connecting line and being engagable with said loading buoy. Said marine riser installation may be for the production of hydrocarbon products from the seabed to surface.

Said connecting line may consist of one or more flexible conduit or one or more umbilicals or a combination of flexible conduits and umbilicals.

A plurality of connecting lines may be provided in similar helical configurations, offset angularly about a common axis. Said similar helical configurations may in particular have the same radii and heights. In one embodiment six conduits are arranged around the axis. Applying the invention to a plurality of connecting lines arranged with similar but angularly offset helical paths helps minimize clashing while permitting a compact arrangement.

Said marine riser may be a substantially vertical riser tower, such as a hybrid riser tower. Substantially vertical in this case means vertical as known in the art, and in comparison with catenary risers and other such configurations. However, because such a riser tower may be very long, it may bend or lean some way off true vertical.

Said apparatus may be arranged so that connection to said floating vessel is made when said vessel is positioned substantially vertically above said marine riser and/or disconnectable turret.

The first helical configuration may be stretched relative to the second helical configuration, along substantially the same axis.

The axis of said first and second helical configurations may be substantially vertical.

The first helical configuration may comprise fewer than ten, five or even two complete turns around its axis. In one embodiment there in only one turn, half a turn is also feasible.

Said vessel may be an floating production, storage and offloading vessel (FPSO). Alternatively it could be any type of offshore production unit.

Said apparatus may further comprise a support frame to support said connecting line(s). Said support frame may be anchored to the seabed. Said connecting lines may comprise bend stiffeners or bend restrictors.

A connecting point of the connecting line may be moveable between sea level and 20-40 meters below sea level, the first helical configuration of a connected line may have a height between 80 m and 110 m, and the second helical configuration of a disconnected line may have a height of between 50 and 80 m.

In a practical embodiment the line may be moveable between sea level and 30 meters below sea level, the first helical configuration the of a connected line may have a height of 95 m, and the second helical configuration of a disconnected line may have a height of 65 m.

The radius of the apparatus in said first helical configuration may be in the range 2 m to 8 m while the radius in the second helical configuration is larger.

In a further aspect of the invention there is provided a method of installation of a connecting line from a marine riser to a buoy comprising the steps of:

lowering at least one connecting line from a vessel;

connecting a lower end of said connecting line to the marine riser;

with the connecting line still connected to the vessel, steering said vessel in a substantially circular path substantially centred on said marine riser; and disconnecting said connection line from vessel and connecting the top end of the connection line to said buoy such that said connecting line takes a substantially helical configuration.

The buoy may be a disconnectable turret for connection to a ship. It may be moored to the seabed by anchors and a line. Said mooring may hold it between sea level and 50 m below sea level.

The vessel may make less than one complete circle, a single complete circle, or a number of circles of the substantially circular path, depending on the number of turns in the helical configuration desired.

The connecting line may be lowered from the vessel from a reel or by a winch. It may be connected directly or via a line or rope to the vessel during the first three steps of the method.

Said method may be repeated for a number of connecting lines.

The connecting line may consist of one or more flexible conduit or one or more umbilicals or a combination of flexible conduits and umbilicals.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
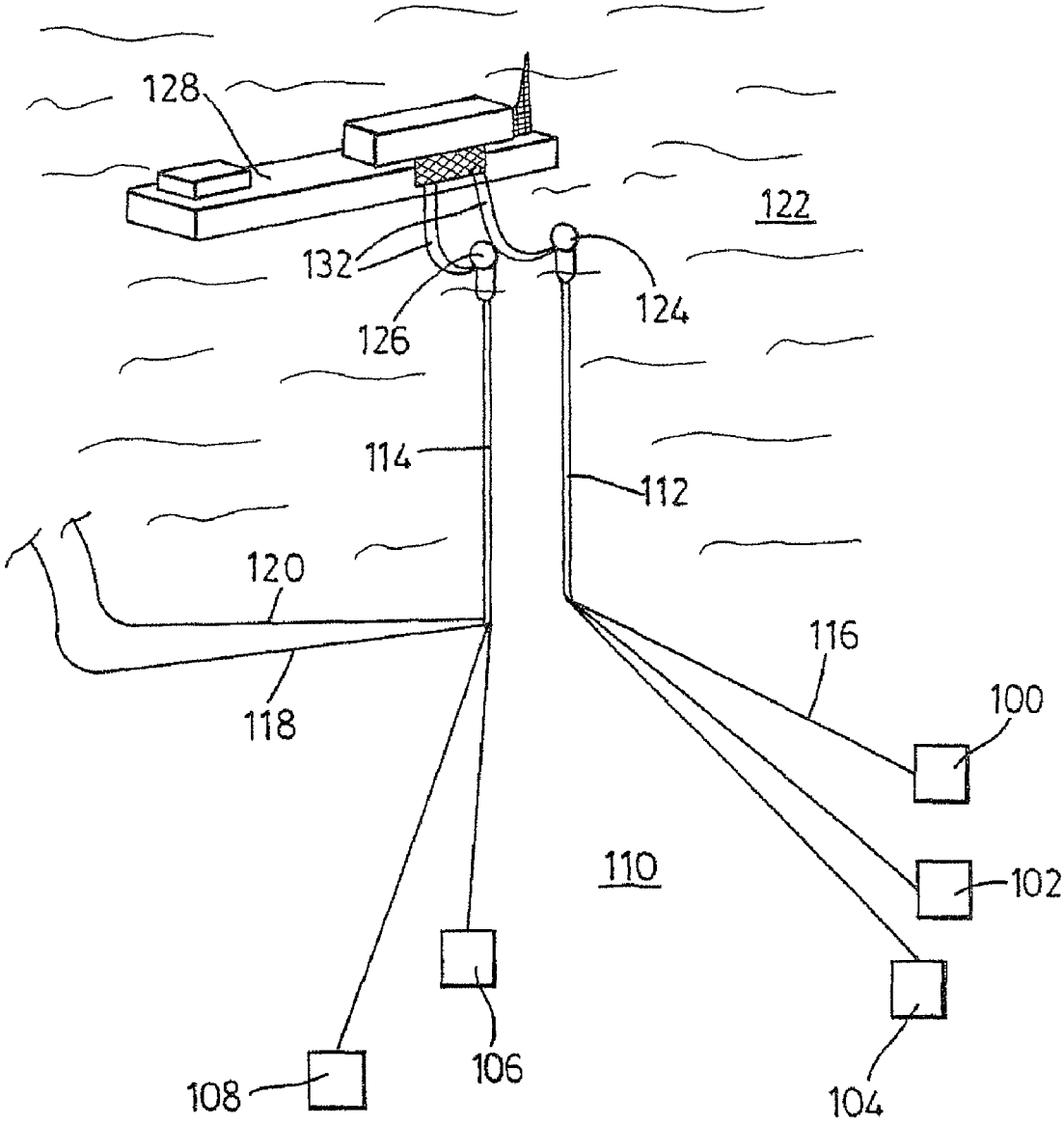
FIG. 1 shows a cut away view of a seabed installation.

Referring to FIG. 1, the person skilled in the art will recognise a cut-away view of a seabed installation comprising a number of well heads, manifolds and other pipeline equipment 100 to 108. These are located in an oil field on the seabed 110.

Vertical riser towers are provided at 112 and 114, for conveying production fluids to the surface, and for conveying lifting gas, injection water and treatment chemicals such as methanol from the surface to the seabed. The foot of each riser, 112, 114, is connected to a number of well heads/injection sites 100 to 108 by horizontal pipelines 116 etc.

Further pipelines 118, 120 may link to other well sites at a remote part of the seabed. At the sea surface 122, the top of each riser tower is supported by a buoy 124, 126. These towers are pre-fabricated at shore facilities, towed to their operating location and then installed to the seabed with anchors at the bottom and buoyancy at the top.

A floating production and storage vessel (FPSO) 128 is moored by means not shown, or otherwise held in place at the surface. FPSO 128 provides production facilities, storage and accommodation for the wells 100 to 108. FPSO 128 is connected to the risers by flexible flow lines 132 etc arranged in a catenary configuration, for the transfer of fluids between the FPSO and the seabed, via risers 112 and 114. Such flexible flow lines do not allow for straightforward disconnection in difficult meteorological conditions. Also in such arrangements the FPSO itself cannot be easily removed from its anchoring system.

Individual pipelines may be required not only for hydrocarbons produced from the seabed wells, but also for various auxiliary fluids, which assist in the production and/or maintenance of the seabed installation. For the sake of convenience, a number of pipelines carrying either the same or a number of different types of fluid are grouped in "bundles", and the risers 112, and 114 in this embodiment comprise bundles of conduits for production fluids, lifting gas, injection water, and treatment chemicals, methanol.

Figure 2:
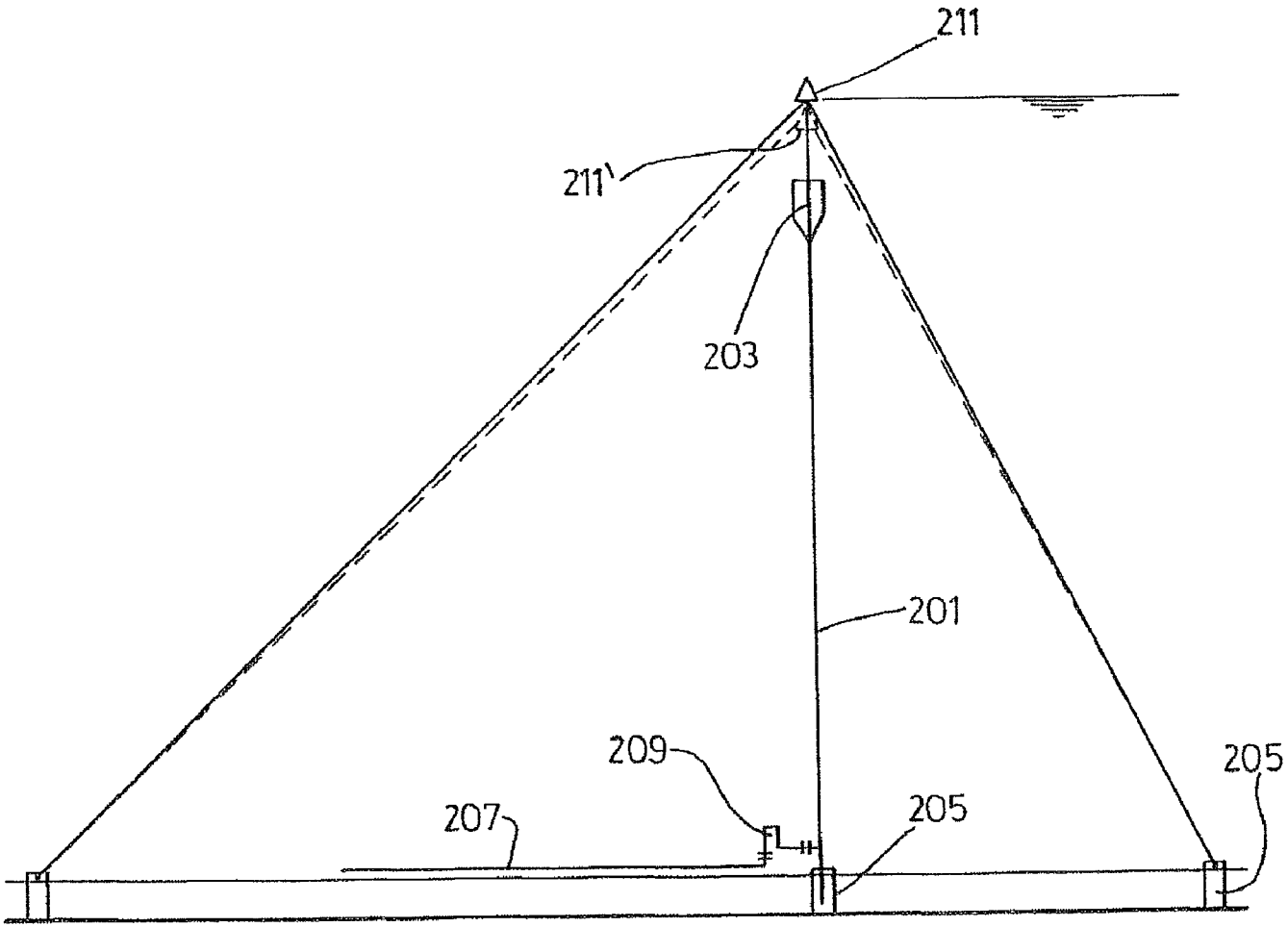
FIG. 2 shows a riser tower installation in accordance with an embodiment of the invention.

FIG. 2 shows a riser tower installation with disconnectable turret positioned vertically above a riser tower. It comprises a riser tower 201 with a top buoy 203 attached to the top end of the riser tower said top buoy providing an upwards force on the riser 201. In this example, the top buoy is located 100 m below the surface. The bottom end of the riser is fixed to the seabed by, for example, a suction anchor 205, and is connected to flowlines 207 via spools 209. This arrangement of top buoy exerting a tension force on the riser which is fixed to the seabed ensures that it is held approximately vertical, at least in comparison to other systems.

Attached to the top of this buoy via a helical connecting line (not shown on this drawing), and also anchored to the seabed by suction anchors 205, is the disconnectable turret or loading buoy. This is shown here in its operational position 211 where it can be connected to a vessel, and in a retracted (disconnected) position 211'.

When the turret is connected it is at sea level and mated with the vessel. When the turret is disconnected, it takes, under the action of its mooring, an equilibrium position about 30 m below. The top of the HRT does not move vertically.

Figure 3:
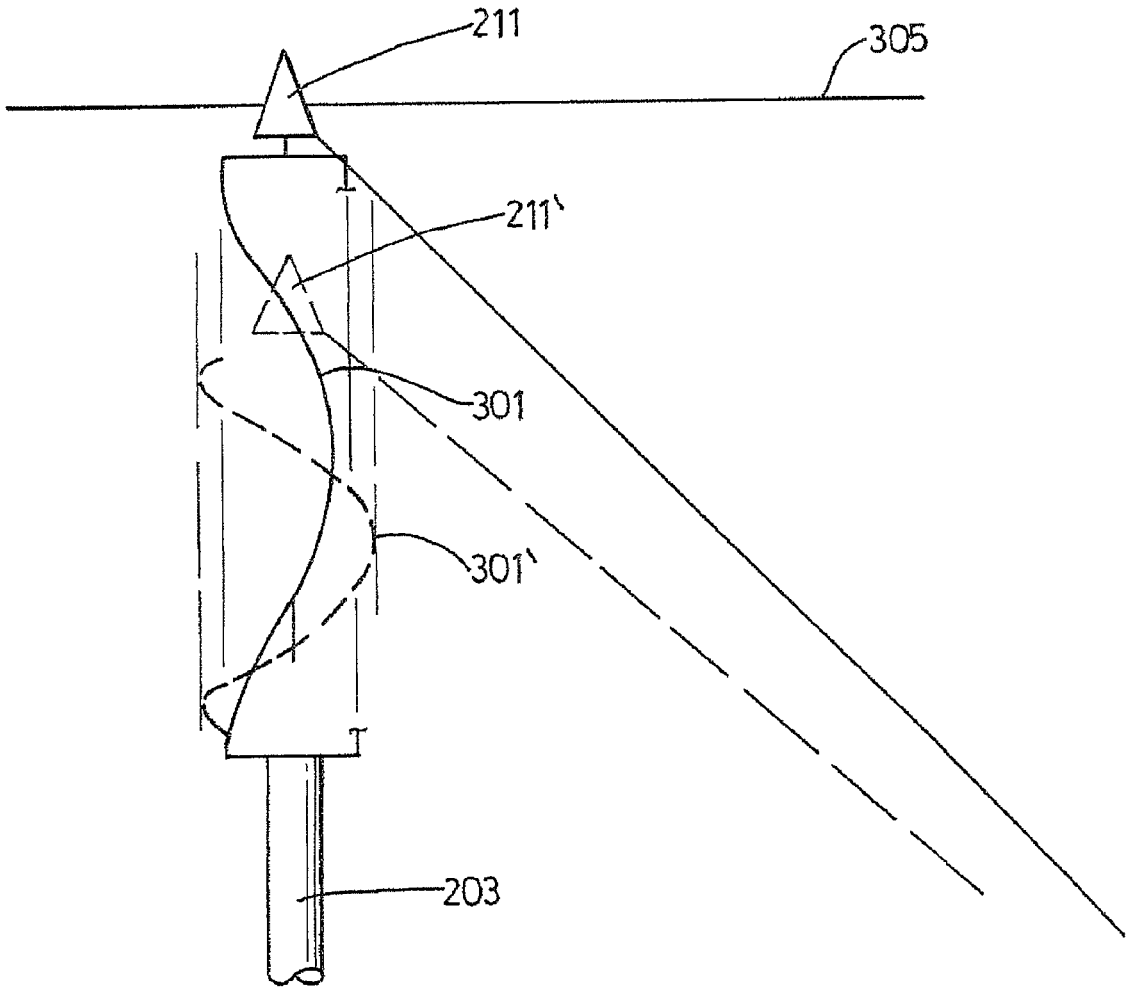
FIG. 3 shows a detail of the turret arrangement of FIG. 2.

FIG. 3 shows a detail of the turret 211,211' and connecting line 301,301' in its operational and disconnected positions. This shows the helical connecting lines 301, 301' in two helical configurations. In the first, extended, configuration 301, turret 211 rises partially through the surface of the water (in this example; however systems can be envisaged wherein a turret or loading buoy remains submerged, or the turret is raised fully clear of the water to mate with, say, an external cantilevered mooring system). The turret 211 can then be mated with a mooring system of an FPSO or other vessel. When the turret 211' is disconnected it is lowered under the sea surface 305, for example by 30 m. In this case the connecting lines take on the second, retracted, helical configuration 301'. It can be seen that in this position the helical connecting lines 301' have a wider envelope, compared to the connecting lines 301 when in the connected position.

Figure 4:
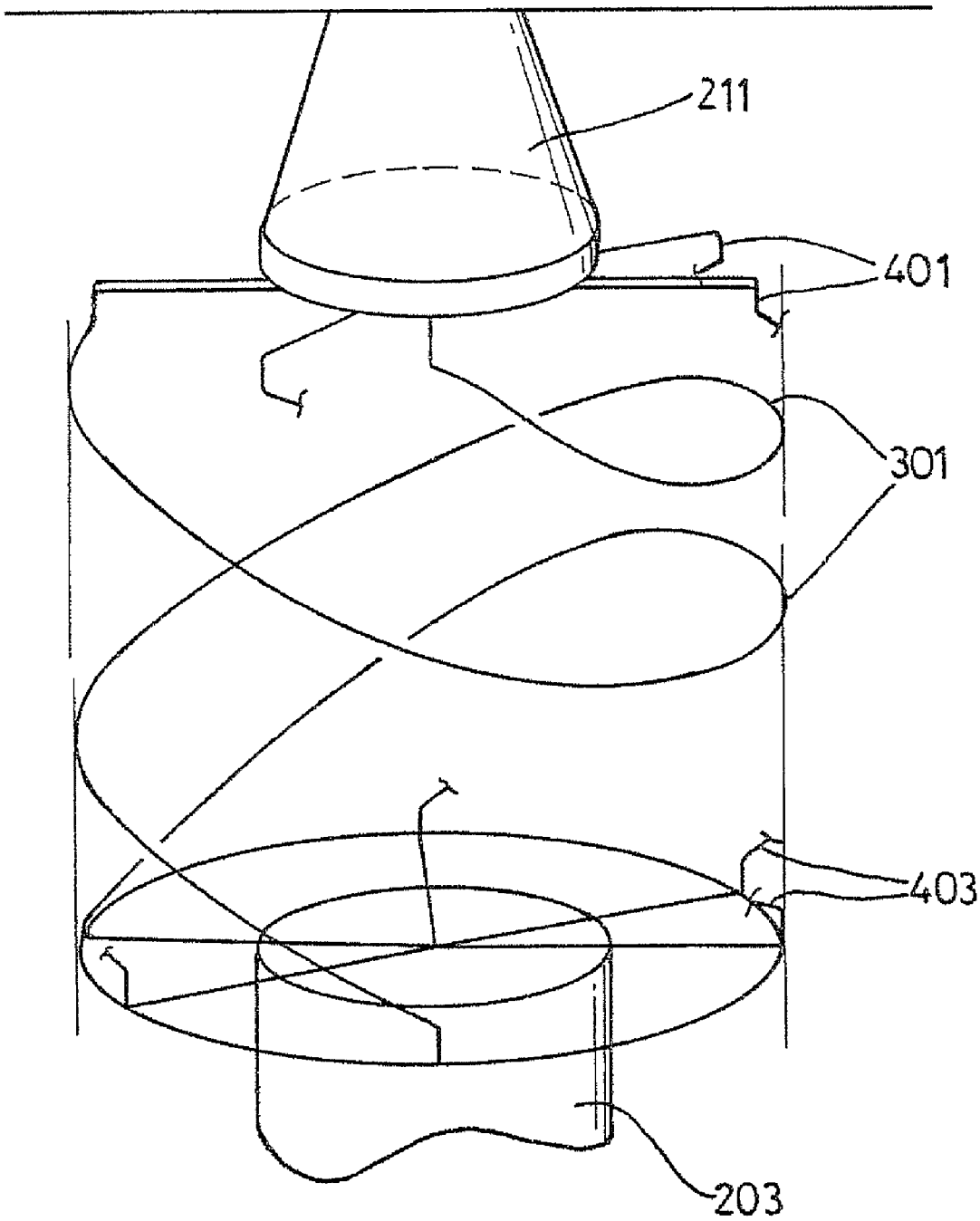
FIG. 4 shows the connecting arrangement of an embodiment of the invention.
Figure 5:
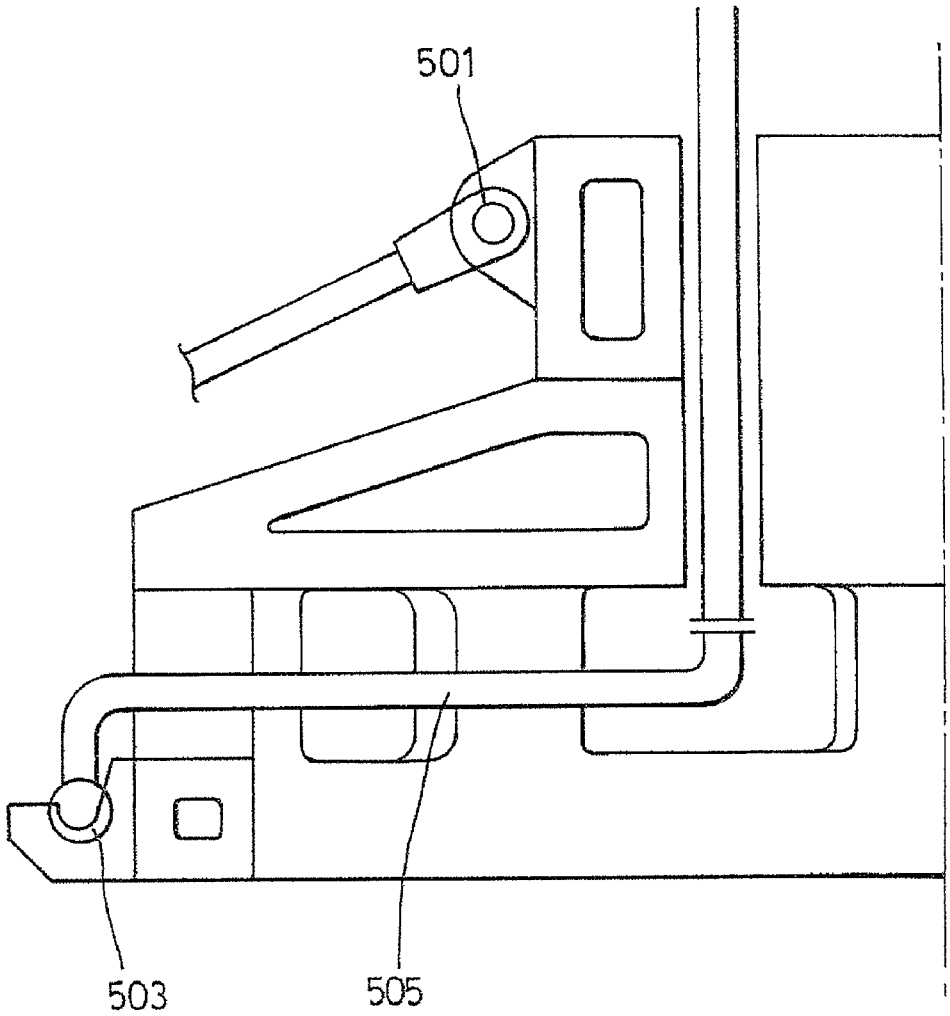
FIG. 5 shows a detail of the supporting structure at the bottom of the turret.

FIG. 4 shows the connecting line arrangement in more detail. This shows six connection points 401 on the turret 211 and a corresponding six connection points 403 on the top buoy 203. Each of the connection points 401 is connected to its corresponding connection point 403 by a connecting line 301 in a helical configuration (only two lines are shown here for clarity). Fluids are passed through the riser tower to the turret and ultimately to the FPSO via these connecting lines. A supporting structure at the bottom of the turret to hold the connections is shown in FIG. 5 (with only one line shown for clarity. The structure is an extension of the turret structure built of plates and stiffeners. This shows the mooring line connection 501, the receptacle for the connecting line 503 and a spool 505. Bend stiffeners (or bend restrictors) may be required to guide the path of the flexibles.

An advantage of this helical arrangement is that the curvature of the connecting lines is kept relatively constant between the two positions and thus remains consistent with the bending radius of the flexible pipelines or umbilicals which make up the connecting lines. For instance, assuming an average height of the helix to be 80 m (the turret being moveable from 65 m above the riser tower to 95 m above the riser tower), it can be shown that the average radius of the helix would be 8.4 m (that is the radius being 12 m and 4.73 m respectively). From this it can be shown that the average radius of curvature would be 21.13 m, and would stay in the range of 19.85 m to 22.35 m. This is well outside the minimum radius of curvature of the flexible. Obviously these figures are for illustration only.

A further advantage is that the length of these connections can be kept to a minimum as the turret (and the FPSO) can now be conveniently located in a geostationary position directly above the riser tower.

Figure 6:
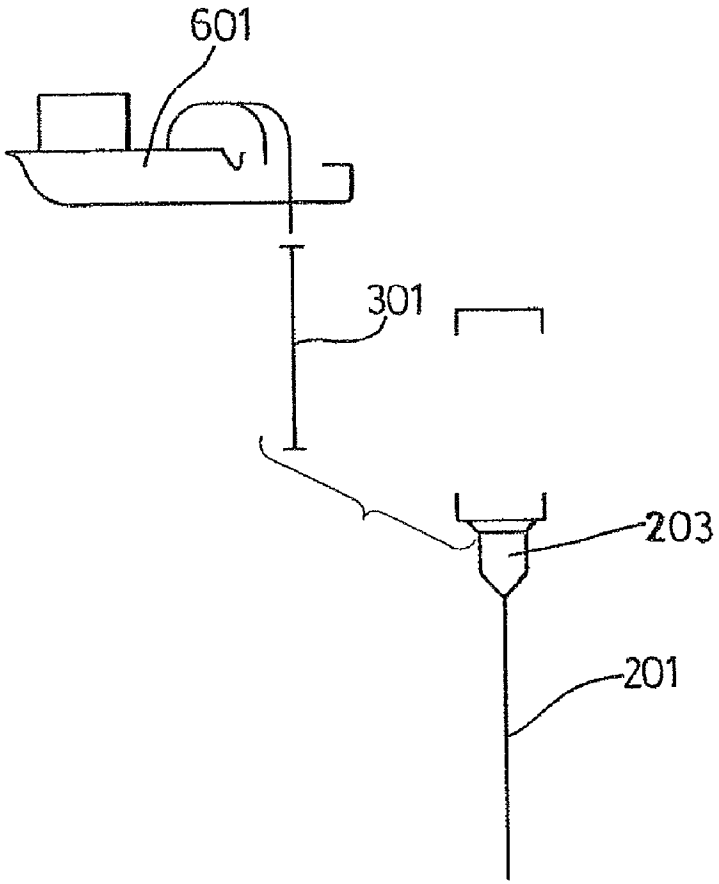
FIG. 6 shows a depiction of a first step of a method of installation according to an embodiment of the invention.
Figure 6:
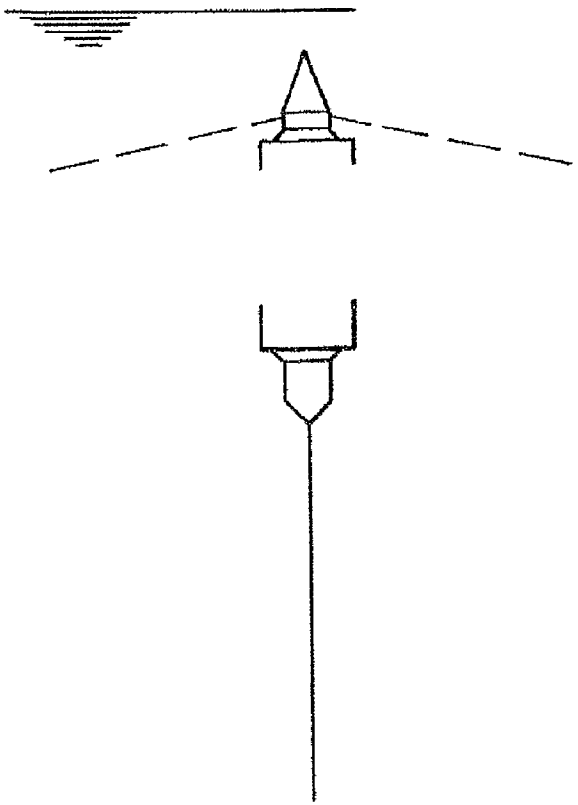

FIG. 6 shows a depiction of the first step of the method of installation of the connecting line. It first shows the buoy tethered to the seabed in a position directly above the riser. The connecting line 301 is lowered from a ship 601 and connected to the top of the riser tower. After this the ship circles around the HRT 360 degrees. The final step is connecting the top end of the connection line to the buoy.

The embodiments mentioned above are for illustrative purposes only and other embodiments and variations can be envisaged with departing from the spirit and scope of the invention.

The invention claimed is:

1. A subsea installation comprising a marine riser and apparatus for the connection/disconnection of the marine riser to a floating vessel, the riser comprising at least one conduit extending from the seabed toward the surface and having an upper end supported at a depth below the sea surface by a submerged buoy, which maintains the riser substantially vertical and in tension, the connection/disconnection apparatus comprising at least one connecting line having a lower end attachable to the upper end of said riser and an upper end connectable to the floating vessel, the connecting line being operable in first and second helical configurations, the connection line in the first helical configuration being extended to allow connection between the riser and the floating vessel, and in the second helical configuration being compressed relative to the first helical configuration, such that the upper end of said connecting line is disconnected from said floating vessel and retracted to a depth below the vessel.

2. The installation as claimed in claim 1 wherein said connection is via a turret attached to said connecting line, said turret being engagable with said vessel.

3. The installation as claimed in claim 1 wherein said connection is via a loading buoy, remote to said vessel.

4. The installation as claimed in claim 3 wherein said loading buoy is attached directly to the connecting line.

5. The installation as claimed in claim 3 wherein said loading buoy is attached via a turret to the connecting line and being engagable with said loading buoy.

6. The installation as claimed in claim 1 wherein said marine riser installation is for the production of hydrocarbon products from the seabed to surface.

7. The installation as claimed in claim 1 wherein said connecting line consists of one or more flexible conduits or one or more umbilicals or a combination of flexible conduits and umbilicals.

8. The installation as claimed in claim 1 wherein a plurality of connecting lines is provided in similar helical configurations, offset angularly about a common axis.

9. The installation as claimed in claim 8 wherein said similar helical configurations have the same radii and heights.

10. The installation as claimed in claim 9 wherein six conduits are arranged around the axis.

11. The installation as claimed in claim 1 wherein said marine riser is a substantially rigid vertical riser tower.

12. The installation as claimed in claim 1 wherein said apparatus is arranged so that connection to said floating vessel is made when said vessel is positioned substantially vertically above said marine riser and/or disconnectable turret.

13. The installation as claimed in claim 1 wherein the axis of said first and second helical configurations are substantially vertical.

14. The installation as claimed in claim 1 wherein the first helical configuration comprises fewer than ten complete turns around its axis.

15. The installation as claimed in claim 1 wherein the first helical configuration comprises fewer than five complete turns around its axis.

16. The installation as claimed in claim 1 wherein the first helical configuration comprises fewer than two complete turns around its axis.

17. The installation as claimed in claim 16 wherein there is only one turn or half a turn.

18. The installation as claimed in claim 1 wherein said vessel is an floating production, storage and offloading vessel (FPSO).

19. The installation as claimed in claim 1 wherein said vessel is any type of offshore production unit.

20. The installation as claimed in claim 1 wherein said apparatus further comprises a support frame to support said connecting line(s).

21. The installation as claimed in claim 20 wherein said support frame is anchored to the seabed.

22. The installation as claimed in claim 1 wherein said connecting lines comprise bend stiffeners or bend restrictors.

23. The installation as claimed in claim 1 wherein a connecting point of the connecting line is moveable between sea level and 20-40 meters below sea level, the first helical configuration of a connected line has a height between 80 m and 110 m, and the second helical configuration of a disconnected line has a height of between 50 and 80 m.

24. The installation as claimed in claim 23 wherein the line is moveable between sea level and 30 meters below sea level, the first helical configuration the of a connected line has a height of 95 m and the second helical configuration of a disconnected line has a height of 65 m.

25. The installation as claimed in claim 1 wherein the radius of the helix in said first helical configuration is in the range 2 m to 8 m and the radius of the helix in the second helical configuration is larger.

26. A method installing a connecting line from a marine riser to a buoy comprising the steps of:

lowering at least one connecting line from a vessel;

connecting a lower end of said connecting line to the marine riser;

with the connecting line still connected to the vessel, steering said vessel in a substantially circular path substantially centered on said marine riser;

disconnecting said connection line from vessel; and connecting the top end of the connection line to said buoy such that said connecting line takes a substantially helical configuration.

27. The method as claimed in claim 26 wherein the buoy is a disconnectable turret for connection to a ship.

28. The method as claimed in claim 26 comprising mooring said buoy to the seabed by anchors and a line.

29. The method as claimed in claim 28 wherein said mooring holds said buoy between sea level and 50 m below sea level.

30. The method as claimed in claim 26 wherein the vessel makes one of less than one complete circle, a single complete circle, or a number of circles of the substantially circular path, depending on the number of turns in the helical configuration desired.

31. The method as claimed in claim 26 wherein said lowering is from a reel or a winch.

32. The method as claimed in claim 26 wherein said connecting line is connected directly to the vessel during the first three steps of the method.

33. The method as claimed in claim 26 wherein said connecting line is connected via a line or rope to the vessel during the first three steps of the method.

34. The method as claimed in claim 26 wherein said method is repeated for a number of connecting lines.

35. The method as claimed in claim 26 wherein the connecting line consists of one or more flexible conduit or one or more umbilicals or a combination of flexible conduits and umbilicals.

* * * * *